US010201813B2

(12) United States Patent
Leard, IV

(10) Patent No.: US 10,201,813 B2
(45) Date of Patent: Feb. 12, 2019

(54) DEVICE AND METHOD OF MICROBIOLOGY WASTE CONTAINMENT

(71) Applicant: Norman W. Leard, IV, Port Jefferson Station, NY (US)

(72) Inventor: Norman W. Leard, IV, Port Jefferson Station, NY (US)

( * ) Notice: Subject to any disclaimer, the term of this patent is extended or adjusted under 35 U.S.C. 154(b) by 187 days.

(21) Appl. No.: 14/747,664

(22) Filed: Jun. 23, 2015

(65) Prior Publication Data

US 2016/0001974 A1 Jan. 7, 2016

Related U.S. Application Data

(60) Provisional application No. 62/019,988, filed on Jul. 2, 2014.

(51) Int. Cl.
*B01L 9/00* (2006.01)
*B01L 1/00* (2006.01)

(52) U.S. Cl.
CPC ..... *B01L 9/52* (2013.01); *B01L 1/50* (2013.01); *B01L 2200/082* (2013.01); *B01L 2300/0609* (2013.01); *B01L 2300/0822* (2013.01)

(58) Field of Classification Search
CPC ..... B01L 9/52; B01L 1/50
See application file for complete search history.

(56) References Cited

U.S. PATENT DOCUMENTS 4,591,061 A * 5/1986 Hedgley ..... B01L 1/50 215/12.1
6,358,473 B1 * 3/2002 Coello ..... G01N 1/312 219/385
6,746,851 B1 * 6/2004 Tseung ..... G01N 1/312 435/40.5
2005/0003522 A1 * 1/2005 Carlsen ..... B01L 9/52 435/287.2
2005/0226780 A1 * 10/2005 Sandell ..... B01L 3/5027 422/400
2007/0237684 A1 * 10/2007 Hansen ..... A61B 10/0096 422/400
2012/0028298 A1 * 2/2012 Takayama ..... G01N 1/312 435/40.52
2013/0034476 A1 * 2/2013 Daf ..... G01N 35/1002 422/565
2013/0071303 A1 * 3/2013 Macnamara ..... B01L 3/50857 422/500

* cited by examiner

*Primary Examiner* — Matthew D Krcha
(74) *Attorney, Agent, or Firm* — Kane Kessler, P.C.; Barry E Negrin

(57) ABSTRACT

A microbiology waste containment apparatus and method are provided to prevent toxic slide staining chemicals from being dumped down a drain during slide staining and thus entering publicly owned water treatment works. A primary containment vessel is provided having side walls and an open top area, and a funnel is provided in communication with the open top area. A secondary containment vessel is in fluid communication with the funnel. When microbiology waste is generated above the open top area, the microbiology waste is collected by the funnel and conducted to the secondary containment vessel. The secondary vessel may be disposed internally to the primary vessel, or it may be external to the primary vessel. In the case of the internal secondary vessel, the entire apparatus may be portable and thus appropriate for field or military work.

8 Claims, 12 Drawing Sheets

Microbiology Containment and Satellite Accumulation Area

Please keep closed when not in use.

Full waste containers must be brought to the Central (Main) Accumulation Area within 72 hours.
No waste may be stored for more than _____ days (as per state and or federal regulations)

HAZARDOUS WASTE

Start Date:_____

Contents: Methanol Stains

Microbiology Containment and Satellite Accumulation Area

Please keep closed when not in use.

Full waste containers must be brought to the Central (Main) Accumulation Area within 72 hours.
No waste may be stored for more than _____ days (as per state and or federal regulations)

HAZARDOUS WASTE

Start Date:_____

Contents: Methanol Stains

Microbiology Containment and Satellite Accumulation Area

Please keep closed when not in use.

Full waste containers must be brought to the Central (Main) Accumulation Area within 72 hours.
No waste may be stored for more than _____ days (as per state and or federal regulations)

HAZARDOUS WASTE

Start Date:_____

Contents: Methanol Stains

FIG. 8

DEVICE AND METHOD OF MICROBIOLOGY WASTE CONTAINMENT

RELATED APPLICATIONS

Priority is claimed from U.S. Provisional Patent Application No. 62/019,988 filed Jul. 2, 2014 and entitled "Device and Method of Microbiology Containment", the teachings of which are entirely incorporated by reference herein.

BACKGROUND OF THE INVENTION

Field of the Invention

This invention pertains generally to waste disposal, and more particularly to devices and method for the capture for disposal of EPA regulated waste materials generated by conventional Microbiology/Histology/Pathology laboratories in hospital/laboratory settings.

Description of Related Art

Pursuant to the US Environmental Protection Agency's Resource Conservation and Recovery Act (40 CFR), a number of hazardous materials are supposed to be captured and disposed of in a safe manner, not simply flushed into the waterways. Unfortunately, otherwise regulated waste materials are currently being discharged by nearly every Microbiology/Histology/Pathology laboratory in every hospital/laboratory setting where microscopic slides are prepared into the publicly owned treatment works (POTW, i.e., down the drain). The current, standard procedure is to suspend the microscope slides over a sink with a commercial metal slide holder and pour stain solutions over the slides, then rinse them. The resultant stain solutions and rinse go into the sink, staining the sink purple, and then eventually goes down the drain to the POTW.

Despite the lack of a commercially available device to capture this effluent, the Laboratories (Waste Generators) are responsible for capturing this material for disposal as RCRA Hazardous Waste. Some are doing this, using a plastic tray in the sink under the slide rack. This is unacceptable because of the lack of containment and the very real possibility of the waste materials entering the POTW via the sink drain.

The waste materials include stain solutions containing Methanol (EPA D001, F003) and some metals, such as Chromium (EPA D007) and Silver (EPA D011). Such materials should not simply go down the drain of a sink. There is currently no commercially available device to address this issue. Accordingly, there is a long-felt need to provide a mechanism and method for preventing these toxic substances from simply being sent down the drain to the public water works.

SUMMARY OF THE INVENTION

The invention is an apparatus for capturing and enabling safe disposal of toxic waste products, especially those used in slide staining. In one embodiment, the apparatus includes an outer containment vessel and an inner containment vessel disposed inside the outer containment vessel. The outer containment vessel has an open area in its top section in which a specialized funnel can be placed. Optionally, support structures, such as a brackets or flanges, are provided in the outer containment vessel and the funnel rests thereatop. The funnel has a drain in communication with the inner containment vessel. When waste material is generated above the opening in the outer containment vessel, the waste material falls into and is collected by the funnel and conducted to the inner containment vessel where it is safely stored for subsequent removal/recycling/destruction.

In another embodiment, instead of an inner containment vessel, the outer containment vessel may be connected to an external containment vessel of significantly larger size (e.g., 5 gallons or more) than the abovementioned inner containment vessel.

Preferably, in either embodiment, the funnel has a support structure for supporting slides to be stained, so that when slides are stained with toxic substances, the excess stain is collected by the funnel and ends up in the inner/external waste containment vessel.

In another embodiment, a portable system involving containment of waste and having stain solutions and water for rinsing in a carrying case with a handle. This embodiment is ideal for field situations where a laboratory would be needed in a remote location. The use of this system will prevent the discharge of waste materials in the remote location, while allowing the microbiologist(s) to perform the needed diagnosis. Other staining procedures could be used in this manner.

By utilizing this invention, laboratories will avoid liability and non-compliance, and prevent pollution from these materials.

The proposed devise will capture EPA-RCRA hazardous waste generated in microbiology laboratories during microscope slide staining processes. Each microbiology laboratory in every hospital or commercial laboratory will need this device to ensure compliance with RCRA (EPA) regulations.

This invention will capture the used stain and give the microbiologist a place to keep the working stains, all in a self-contained, closeable station, away from sinks and possible discharge. The kit(s) will also function as a satellite accumulation area for the waste effluent, with built in containment. By using a funnel and containment, the EPA waste and Waste/Product storage requirements are satisfied. There are also other staining applications such as the use of silver (D011) and Chromium (D007) for which this device would be applicable.

More specifically, the invention includes a microbiology waste containment apparatus. A primary containment vessel having side walls and an open top area is provided with a funnel in communication with the open top area. A secondary containment vessel is in fluid communication with the funnel. When microbiology waste is generated above the open top area (e.g., when staining a slide), the microbiology waste is collected by the funnel and conducted to the secondary containment vessel. Preferably, a slide staining support is disposed in one of i) the open top area, or ii) the funnel, and is adapted to support slides being prepared with chemicals that become microbiology waste following a slide staining procedure.

Optionally, the funnel is dimensioned substantially the same size as the open top area. Alternatively and preferably, the funnel further includes flanges adapted to engage a lip in the primary containment vessel just below the open top area. The flanges are preferably adjustable in length so as to accommodate primary containment vessels of different sizes.

In one embodiment, the secondary containment vessel includes an inner containment vessel disposable within the primary containment vessel. Alternatively, the secondary containment vessel includes an external containment vessel outside of the primary containment vessel. In either event, the funnel and the secondary containment vessel are typically connected by tubing.

Preferably, the primary containment vessel further includes storage space beneath the funnel for storing staining materials to be used in a slide staining procedure.

In one embodiment, the invention includes a lid lockable onto the primary containment vessel, and at least one handle disposed on an exterior of at least one of i) the lid, or ii) the primary containment vessel. In this configuration, the apparatus is self-contained and portable.

In another aspect of the invention, the invention includes a non-transitory computer-readable medium encoded with instructions for creating a microbiology waste containment apparatus. The medium includes instructions for creating a primary containment vessel having side walls and an open top area; instructions for creating a funnel adapted to be in communication with the open top area; and instructions for creating a secondary containment vessel adapted to be in fluid communication with the funnel. When the primary containment vessel, the funnel, and the secondary containment vessel are connected together, microbiology waste generated above the open top area is collected by the funnel and conducted to the secondary containment vessel.

In one embodiment, the instructions for creating the secondary containment vessel further include instructions for creating an inner containment vessel disposable within the primary containment vessel. In addition or in the alternative, the instructions for creating the secondary containment vessel further include instructions for creating an external containment vessel outside of and connectable to the primary containment vessel.

Optionally, the instructions further include instructions for creating a lid lockable onto the primary containment vessel; and instructions for creating at least one handle disposed on an exterior of at least one of i) the lid, or ii) the primary containment vessel. When created and assembled, the microbiology waste containment apparatus is self-contained and portable.

In another aspect of the invention, the invention includes a method of containing microbiology waste. A primary containment vessel is provided having side walls and an open top area. A funnel is provided in communication with the open top area. A secondary containment vessel is provided in fluid communication with the funnel. A microbiology slide staining procedure is performed above the open top area. The microbiology waste generated by the performing step is collected by the funnel. Finally, the waste collected by the funnel is conducted to the secondary containment vessel. As above, the secondary containment vessel in this method may be an inner containment vessel, in which case the method further includes the step of disposing the inner containment vessel within the primary containment vessel. In addition or in the alternative, the secondary containment vessel may be an external containment vessel, in which case the method further includes the step of disposing the external containment vessel outside of the primary containment vessel.

BRIEF DESCRIPTION OF THE DRAWINGS

FIG. 8: Schematic depicting dorsal and side signage for the device, especially the outer containment vessel.

FIG. 12A shows the kit with the lid open, and FIG. 12B shows the kit with the lid closed.

DETAILED DESCRIPTION OF THE INVENTION AND DRAWINGS

Description will now be given with reference to the attached FIGS. 1-12. It should be understood that these figures are exemplary in nature and in no way serve to limit the scope of the invention, which is defined by the claims appearing hereinbelow. All dimensions, materials, and the like are also exemplary in nature and can be replaced with other dimensions, materials, and the like without departing from the scope of the invention where practical and advantageous.

Figure 5:
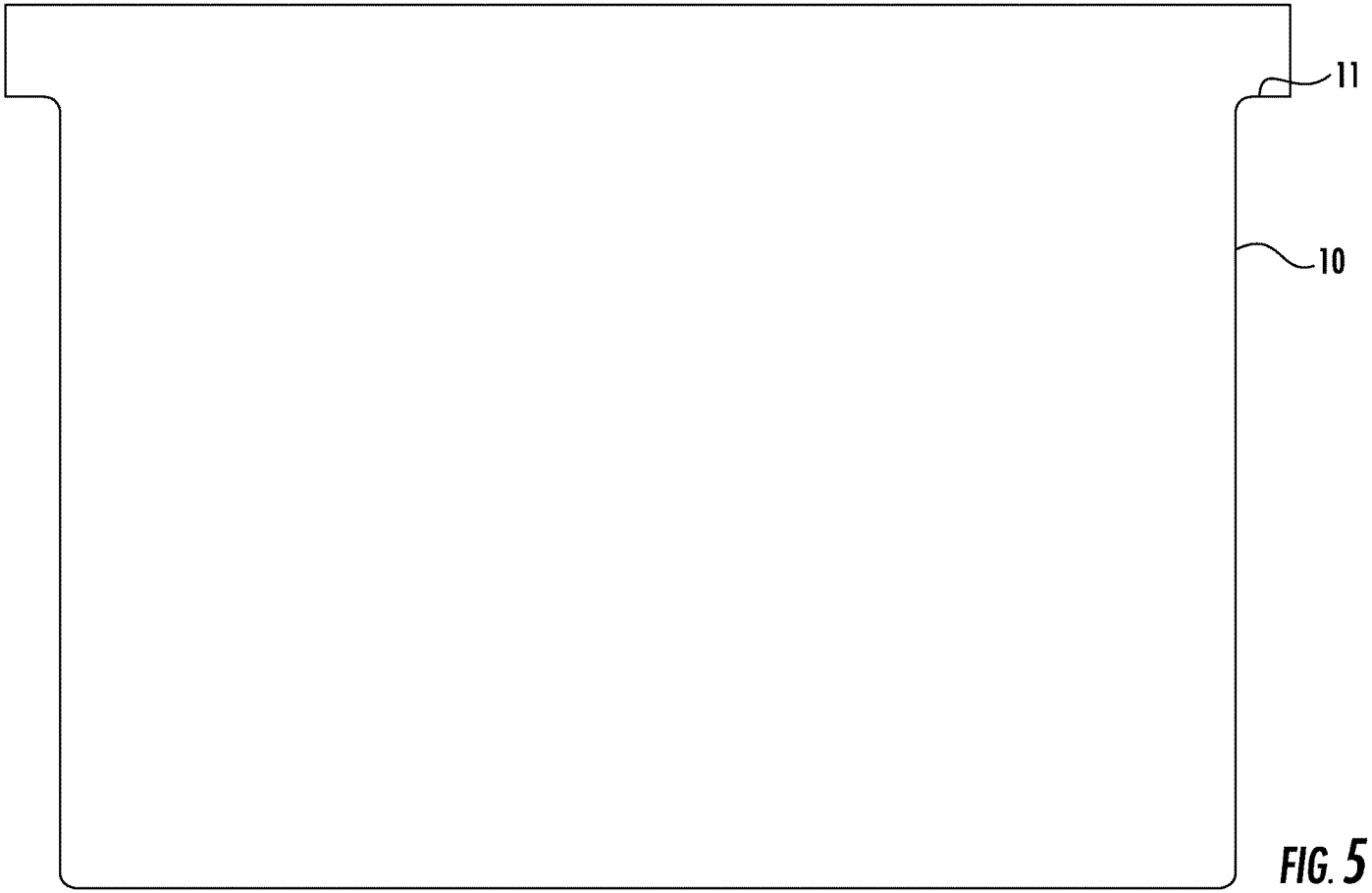
FIG. 5: Lateral view of outer containment vessel, in accordance with the invention.
Figure 6:
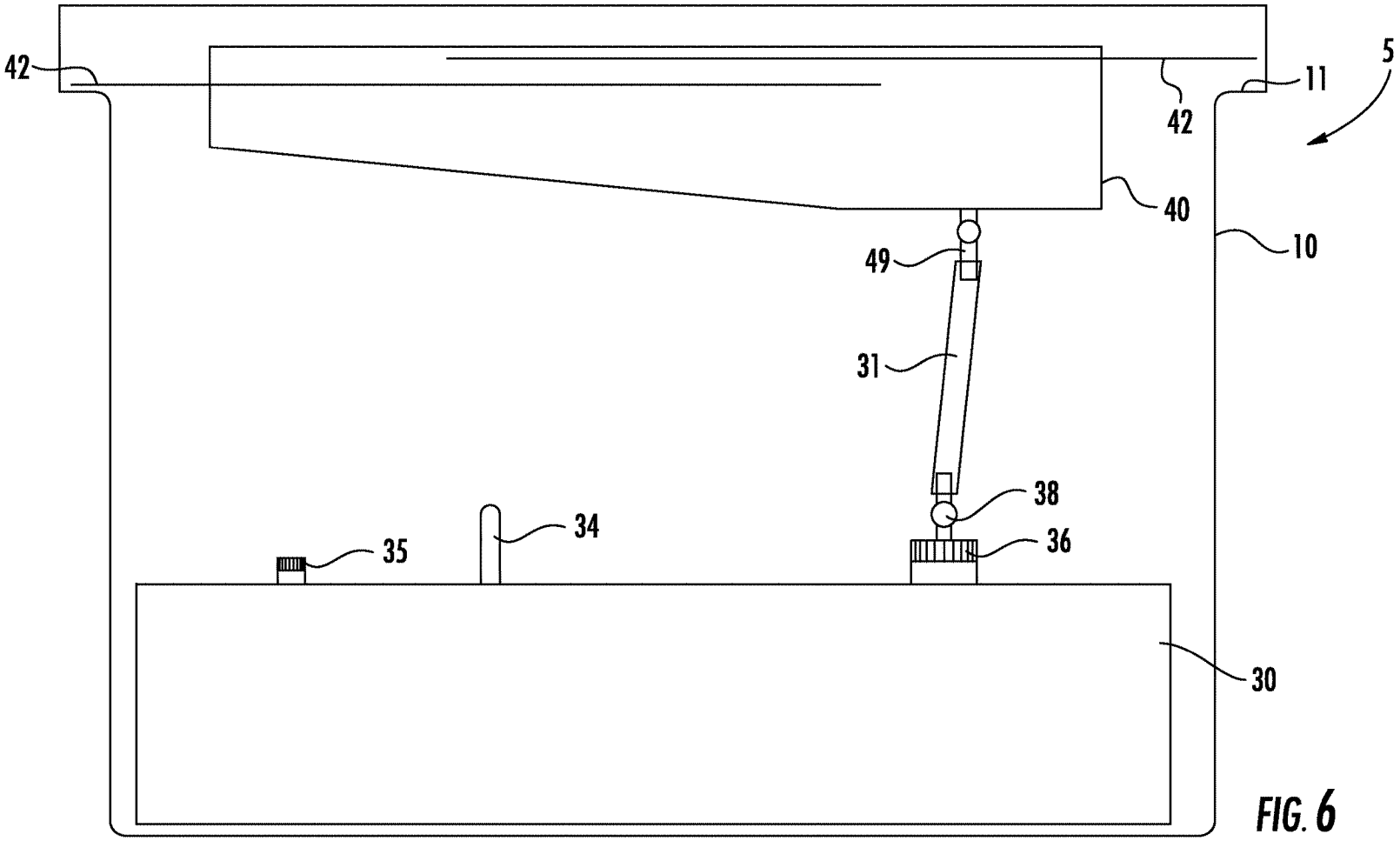
FIG. 6: Side sectional view of funnel and inner containment vessel connected to each other and disposed within the outer containment vessel, in accordance with the invention.
Figure 7:
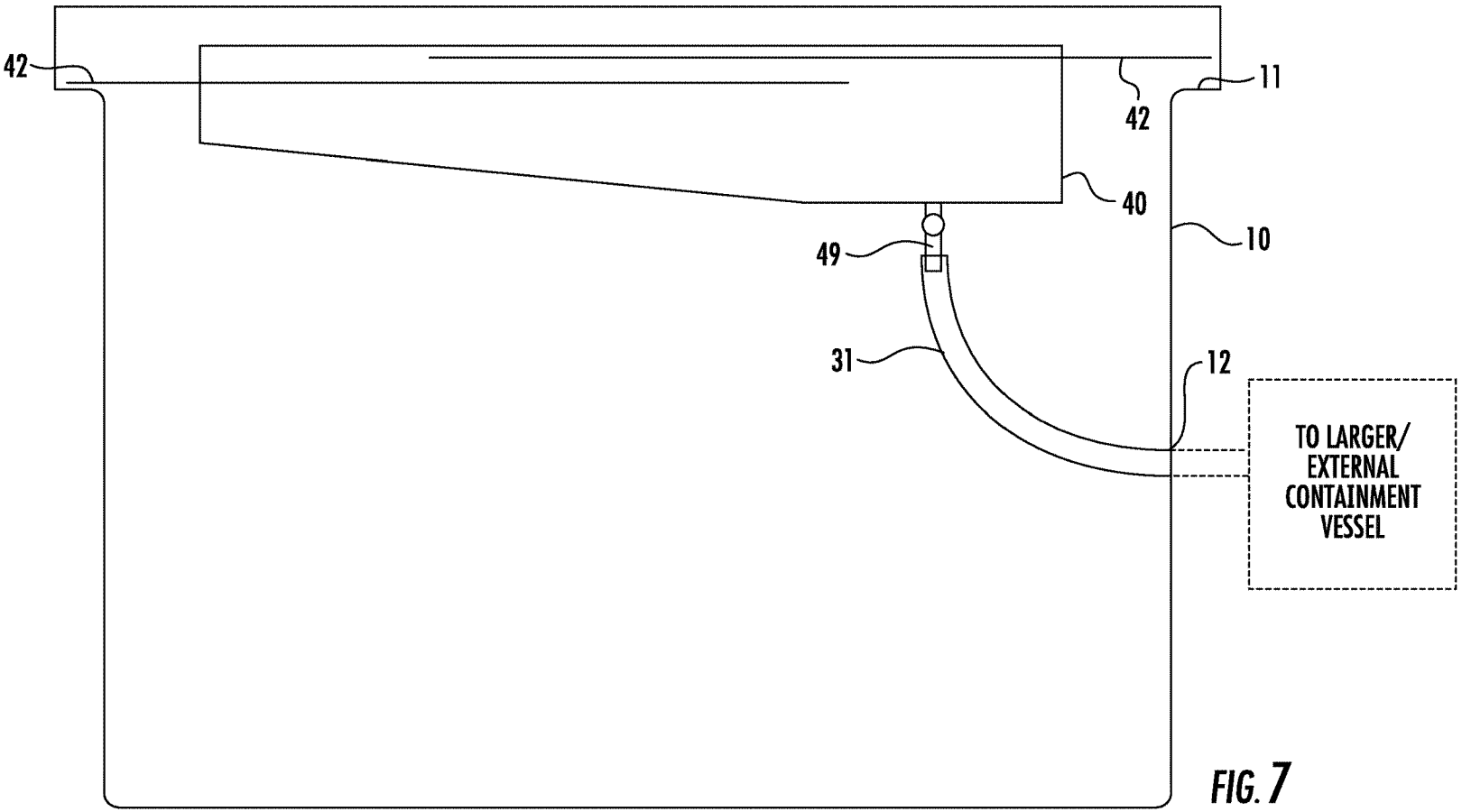
FIG. 7: Side sectional view of funnel disposed within the outer containment vessel and connected to larger external containment vessel, in accordance with the invention.
Figure 9:
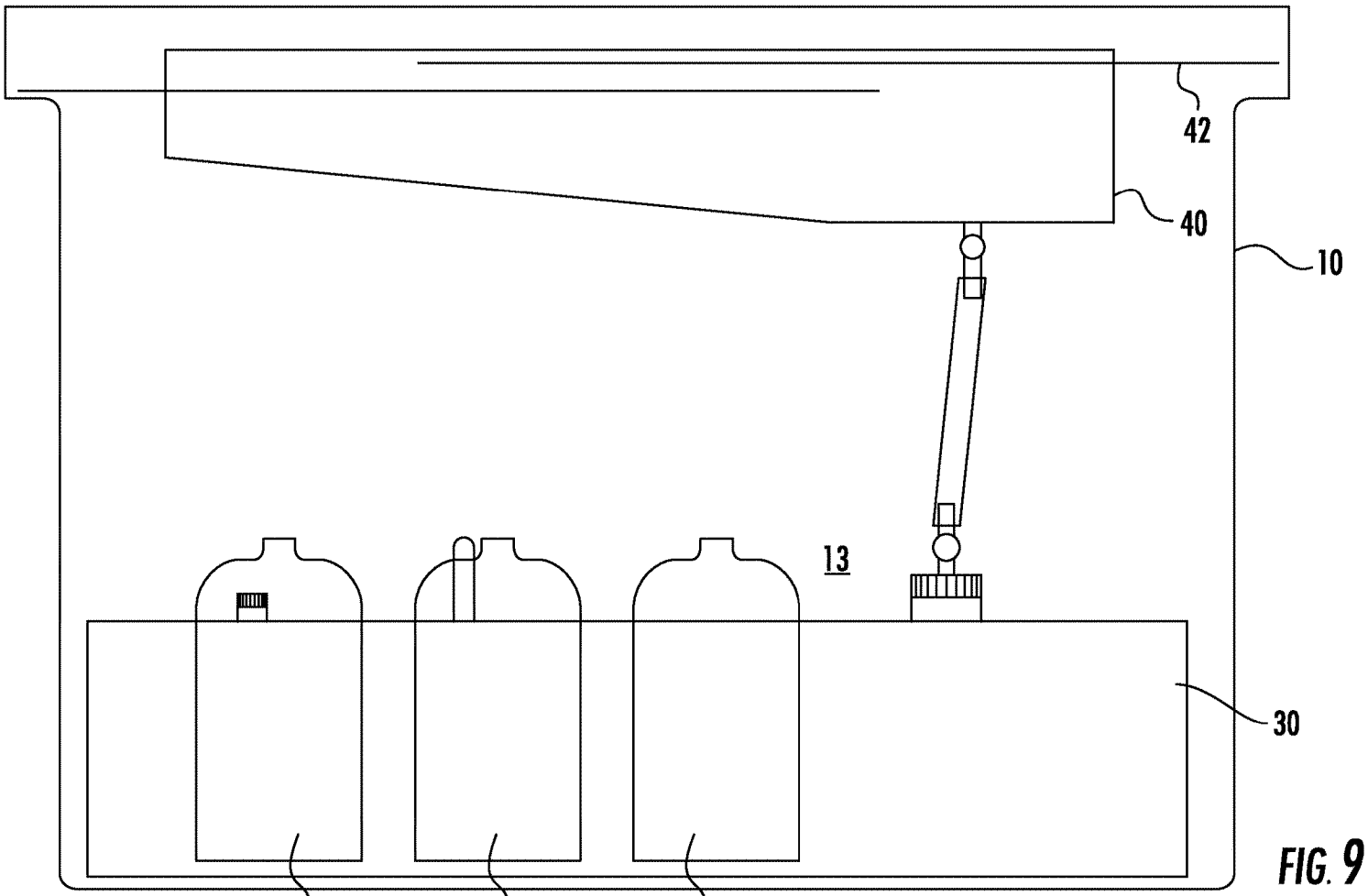
FIGS. 9 and 10: Showing relative position of stain solutions located in the outer containment vessel, either next to the interior waste containment vessel (FIG. 9) or in the containment vessel when the outer (extrinsic) waste container is in use (FIG. 10).
Figure 10:
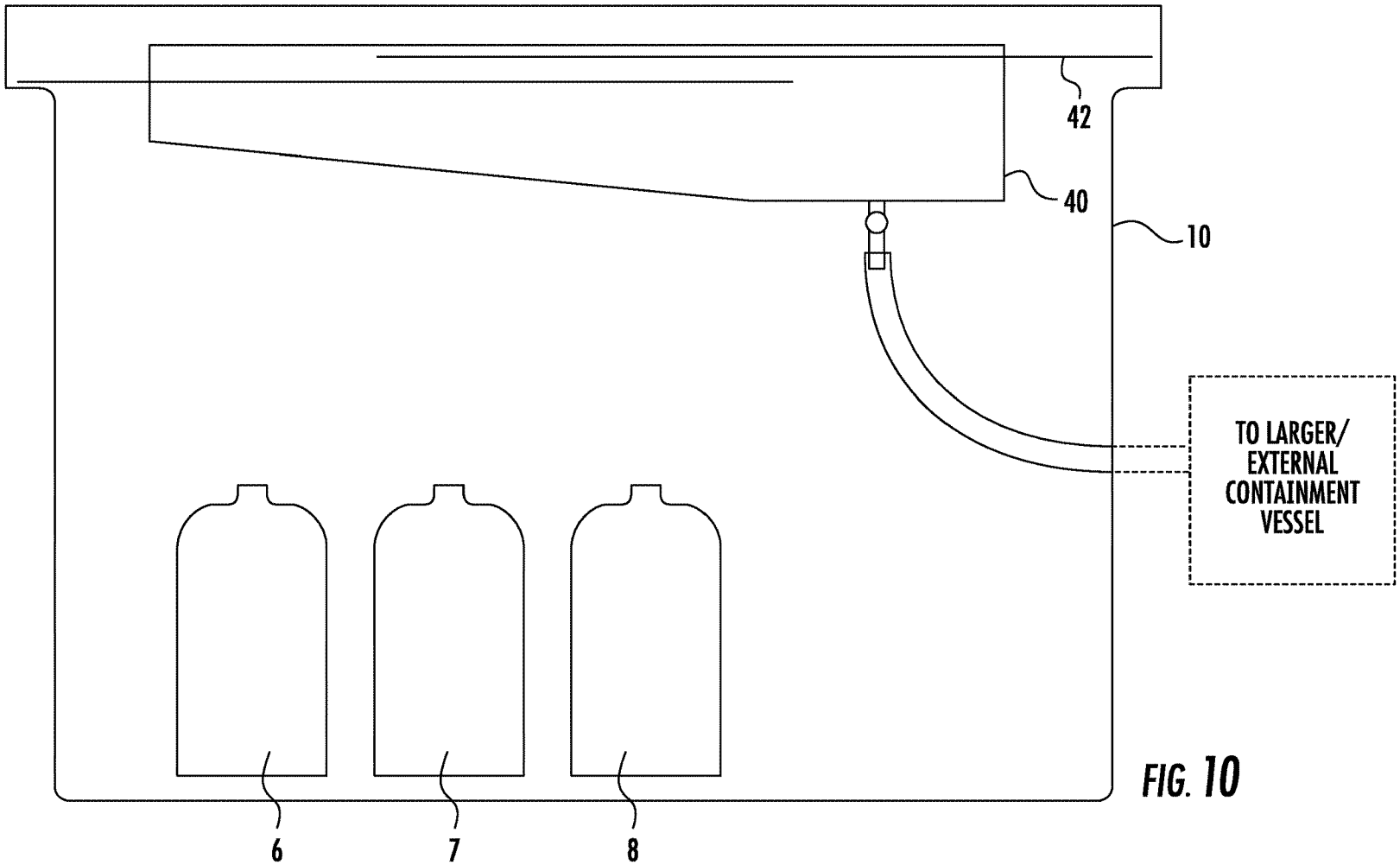
Figures 11A, 11B:
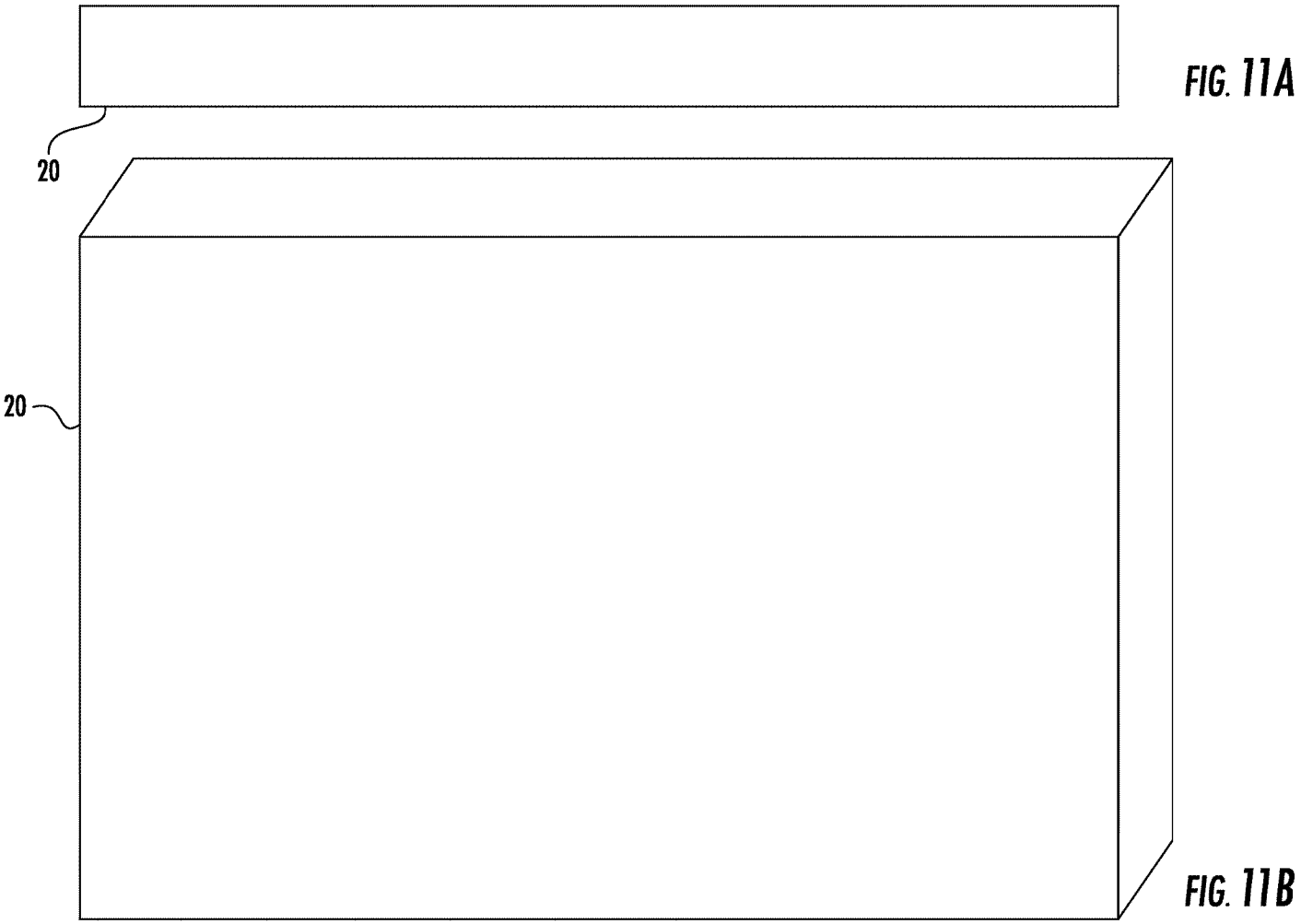
FIGS. 11 A-B: Lateral and dorsal views, respectively, of lid which covers the vessel and can function as containment for the microscope slides prior to being stained or as a staging area for processed microscope slides.

Components:

Primary outer containment vessel 10 (see FIG. 5). A plastic box product preferably, in one embodiment, of the dimensions 18" long (outside), 12" wide (outside), 13¾ Outer height and 12½" inner height with a lip around the top 1⅛" distally, and the 1⅛" up creating a rim 11. One or more sealable exit ports 12 (one shown in FIG. 7) are provided for plastic tubing in the center (6.5") of the width side, and 6½ from the bottom, one on either side. The exit ports are to accommodate tubing, e.g., 5/16 ID tubing, which may be fed to a larger (e.g., 5 Gallon) external labeled waste vessel (see FIG. 7). The port gives laboratories that generate larger volume the option of conveniently capturing that volume. The tube, space permitting, could be fed to an even larger container, as allowable by local and federal authorities. For example, at the time of this writing, EPA regulations allow a maximum of 55 gallon of waste in a Satellite Accumulation Area for a period of no more than one year. Many states, such as New York, are more stringent and only allow accumulation for 180 days. The City of New York Fire Code allows no more than a total of 30 Gallons of flammable liquids per laboratory space, including both product and waste.

The interior 14 of the outer containment vessel 10 has sufficient room for the stain solutions 6, 7, and 8 (see FIGS. 9 and 10), which should be labeled on the top of the bottle as to contents by the user. The interior space also allows the manipulation of the drain and fill valves that leave and enter the two interior components.

Each Length side of the outer containment vessel will preferably be labeled with appropriate warnings, such as shown in FIG. 8 and including optionally the following:

Microbiology Containment and Satellite Accumulation Area.

Please keep closed when not in use.

Full waste containers must be brought to the Central (Main) Accumulation Area within 72 hours.

No waste may be stored for more than _____ days (as per state and/or federal regulations).

Label stating contents (Methanol Stain) and start date.

Warning labels may be placed on other locations of outer containment vessel 10.

Lid 20 (see FIGS. 11A-B): Lid 20 is made to fit with this modified commercially available product. This cover closes the entire unit and can function as containment when placed upside down on a flat surface. The inner components can be placed upon the upside down lid during maintenance operations. The top of the lid shall be labeled appropriately, e.g. as follows:

Microbiology Containment and Satellite Accumulation Area

Please keep closed when not in use.

Full waste containers must be brought to the Central (Main) Accumulation Area within 72 hours.

No waste may be stored for more than [X] days (as per state and/or federal regulations).

Label stating contents (Methanol Stain) and start date.

Secondary containment vessel option 1:

Inner Waste Accumulation Vessel 30 (see FIGS. 4A-B): This is to enable microbiology laboratories with small volume and or limited space to accumulate waste into a reusable container that can be decanted into a larger vessel in the Central (Main) Accumulation Area.

In one embodiment, the dimensions of vessel 30 are: 17" Length, 7" width, and 4" height. The dorsal surface 32 preferably has a handle 34 located 11" from the filling end, a vent 35 about 2¼" on center from the vent end, and a fill port 36 with a valve cap 38 3" on center from the filling end. The filling end is connected to the funnel 40 via a piece of 5/16 inner diameter (ID) tubing 31 to the fill port 36. A separate solid cap (not shown) is supplied to seal the collection vessel so that another one can be put into place. Another valved cap (not shown) can be used to decant the waste into a larger container in the Central Accumulation Area. This container 30 shall be labelled as to contents with a date within regulatory limits. When this container 30 is full, container 30 (or the contents of container 30), are supposed to be removed to the Central Accumulation Area within 72 hours or the like.

Figure 1A:
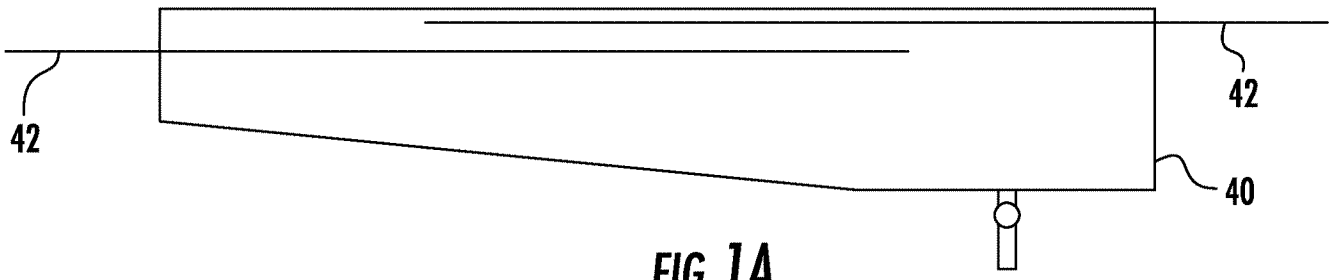
FIGS. 1A-B: Lateral and dorsal view of a funnel, showing positions of drains, dowells, and brackets, in accordance with the invention.
Figure 1B:
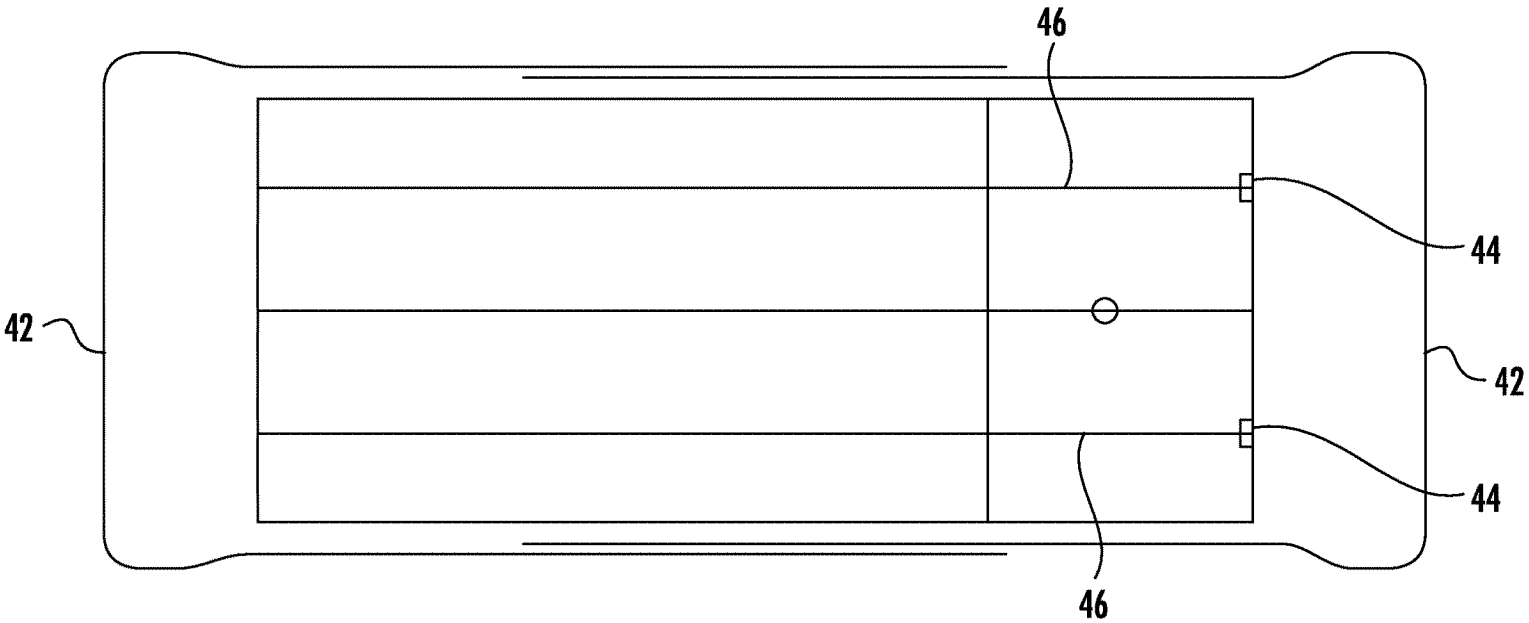
Figure 2:
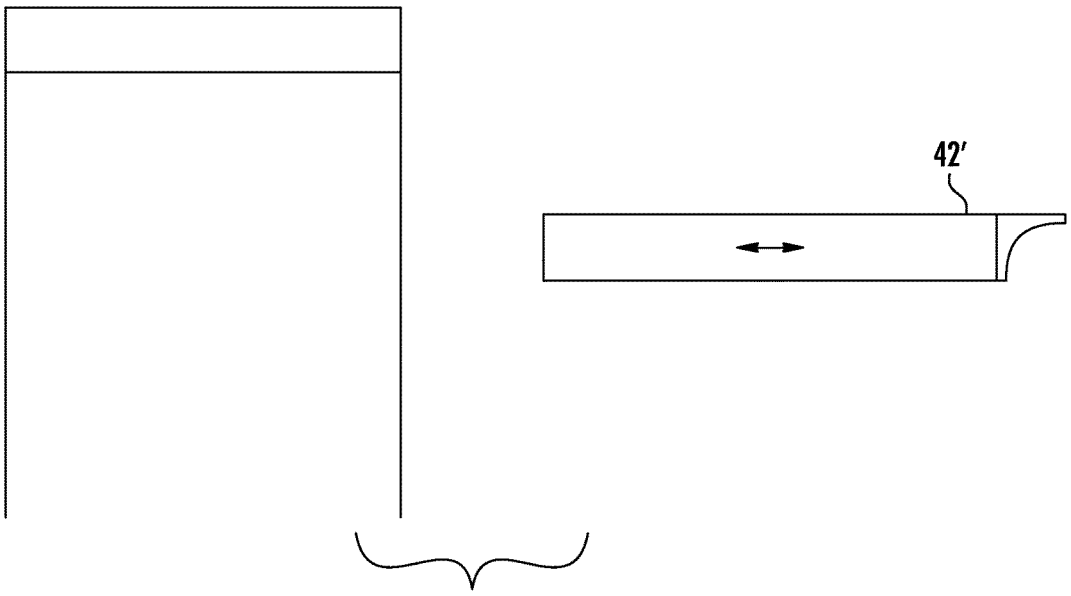
FIG. 2: Dorsal and lateral view of alternative rounded edge funnel brackets, in accordance with the invention.
Figure 3:
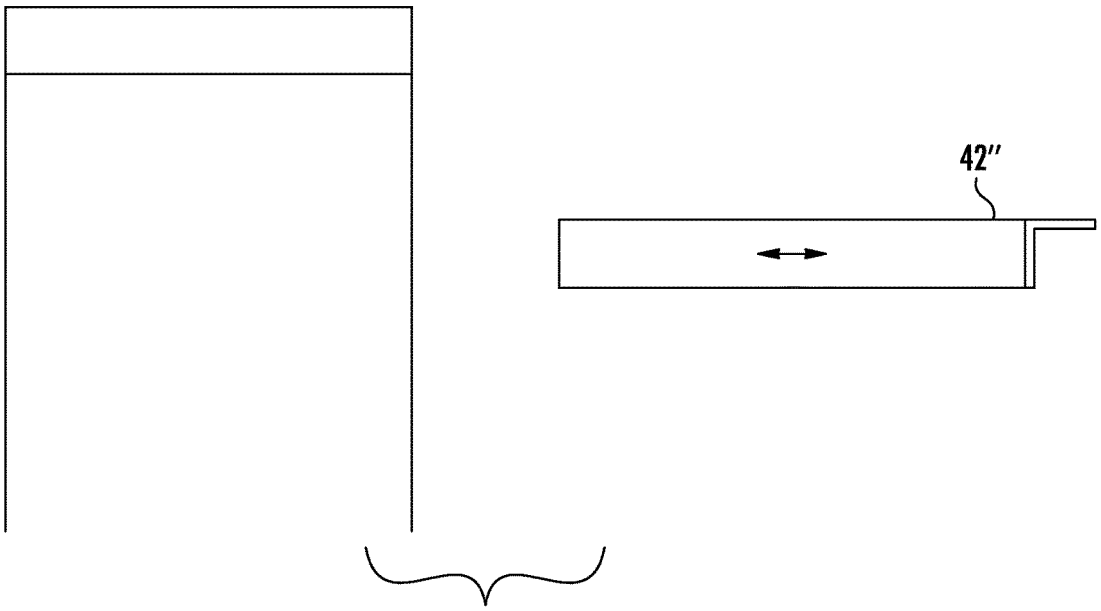
FIG. 3: Dorsal and lateral view of alternative square edge funnel brackets, in accordance with the invention.
Figure 4A:
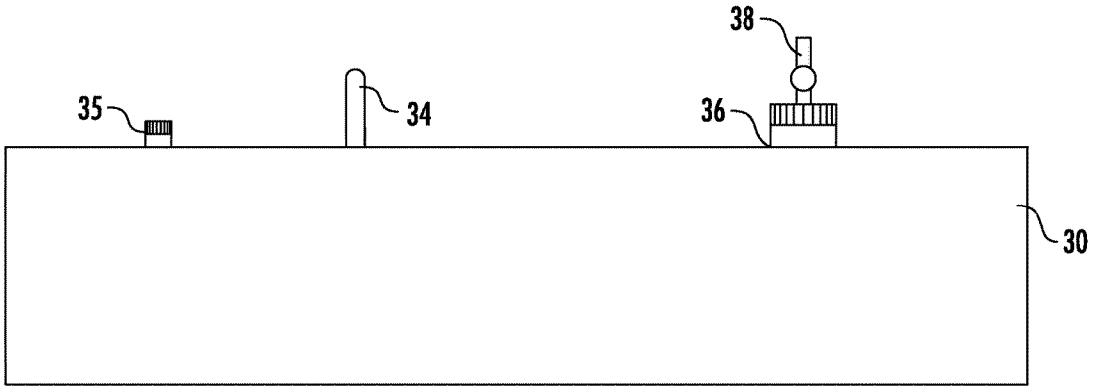
FIGS. 4A-B: Lateral and dorsal views, respectively, of inner waste containment vessel, in accordance with the invention.
Figure 4B:
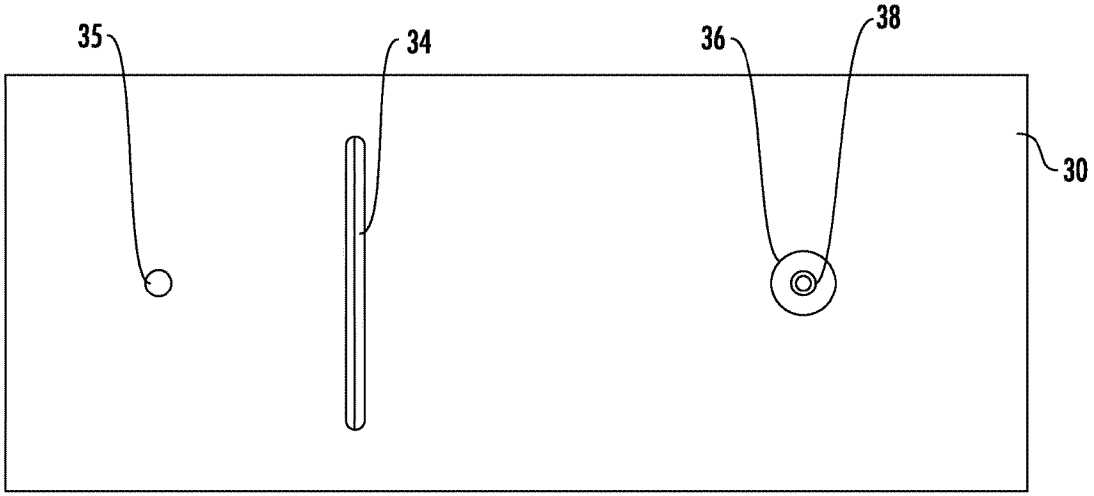

Microbiology Funnel 40 (see FIG. 1): The length of the exemplary funnel body is preferably 14 inches. In one embodiment, the width of the funnel body 6 and ⅛ inches. On each width end is a 1-inch telescoping flange 42 to hold the funnel on/in the upper lip portion 11 of the outer containment vessel 10. It is to fit so that funnel 40 may be slid width-wise in the containment box 10 easily with minimal forward/backward motion. The attachment flanges 42 are adjustable to give the user options. In the preferred embodiment, flanges 42 are made from a stiff wire or coated wire-type structure. An alternative flange 42' with rounded edges is shown in FIG. 2, and an alternative flange 42" with square support surfaces is shown in FIG. 3. Flanges 42' and 42" are optionally interchangeable with flange 42 to give the user options of applications, such as using different containerization, among other things. As another alternative, funnel 40 is simply dimensioned to sit atop outer containment vessel 10 without adjustable flanges, e.g., either with fixed/permanent flanges or with no flanges per se.

In one embodiment, the maximum depth of funnel 40 is preferably 2½ inches at the fill end, centered on 4 inches lengthwise. From the point of 4 inches from the "back" funnel wall, the floor of the funnel ramps up to 1½ inches at the other end, for a distance of Run 10 inches, a Hypotenuse 11 inches, with a drop of 1 inch from the "higher" end to the drain end. At each end, slightly recessed from the funnel lip (½ inch), are brackets 44 located 1¾ inches width at the widest on center to hold two parallel dowels 46 for supporting microscope slides during staining procedures. Although the dowels may be round in section, preferably they have a flattened upper surface so as to provide greater surface area of support for the slides and deter slipping of the slides during staining. Alternatively, slide support dowels 46 may be attachable to outer containment vessel 10 above funnel 40. Additionally, the upper surface of dowels 46 may be provided with a high coefficient of friction (e.g., a non-slip and non-reactive material, or the same material but made rough, etc.) to deter slipping of the slides during staining even further. This may not be necessary as most slideracks are smooth and the weight of the glass is sufficient to keep the slide relatively immobile, even when they are being sprayed with staining material. In any case, dowels 46 are preferably removable for cleaning and replacement purposes. The top of the dowels is ¼ inches recessed from the top of the funnel. The dowels need be no more than ¼ inches in diameter.

The funnel drain 48 is located 2 inches on center from the "deep" end. The drain port feeds into a ball valve tube 49 (see FIG. 6). The ball valve drain tube 49 is attached to plastic tubing 31 which feeds into either the inner waste containment vessel 30 or through one of the ports 12 (located on either "narrow" side) into a larger, contained, waste accumulation vessel.

This device is preferably manufactured from injection molded chemically resistant polypropylene or a similar polymeric or otherwise non-reactive material.

In operation, the invention is used as follows.

Place the entire apparatus 5 on a flat surface.

Remove the lid 20 from the primary containment vessel 10 and place upside down (open side up) on a flat surface. The upside down lid 20 may be utilized as containment for the working slides or any other material utilized in the staining process not contained in the outer containment vessel 10. Assemble the drain cap on the funnel and put the valve in the closed position, with the valve handle across the flow direction.

Option 1 (see FIG. 6):

Using 5/16 ID tubing, connect the funnel valve to the fill valve on the inner waste collection vessel.

Examine the connections to ensure a liquid tight fit.

Open the vent 35 in the back end (near the handle 34) of the inner collection vessel 30.

Open the drain valve 49 on the bottom of the funnel and the fill valve 38 on top of the inner waste containment vessel 30. Label the collection (inner containment) vessel 30 as to content (for example Methanol Stain) with a start date within 180 days (or 1 year, if applicable). Label the working stain solutions 6, 7, 8 (product) dorsally as to content, in plain and clear language, and place in the outer containment box 10 in storage area 13 between the inner containment vessel 30 and the near outer containment vessel wall.

Begin staining and monitor the inner containment vessel 30 so as not to overfill. The inner containment vessel 30 is preferably manufactured out of semi-opaque white plastic. As this will soon be opaque from the waste stain solution, the level may be monitored by observing the level in the container through the vent port, at the opposite end of the fill port on the vessel. (Optionally, a clear section may be formed in inner containment vessel 30.) Take care not to overfill, however if overfilling occurs, it is not a big problem because the waste material is still contained by the outer containment vessel 10.

When full, decant inner containment vessel 30 into a larger container in the Central Accumulation Area or seal and replace the container after placing the full container in the Central (Main) Accumulation area. Label the container as to contents and date the container utilizing a Hazardous Waste Accumulation label. (Exemplary contents: Methanol Stain Solutions.)

Option 2 (see FIG. 7):

Using 5/16 inner diameter tubing 31, run the tubing through one of the side ports 12 in the outer containment vessel 10 to an external waste container and connect to the funnel drain valve 49. If so desired, put another valve (not shown) on the drain end entering the collection container. Label the external waste container as to content and date within 180 days or 1 year if applicable. Preferably provide spill control containment in or on the external waste container. If the external waste container is a five gallon plastic pail, the outer containment vessel should be large enough to contain 5 gallons of liquid.

Examine the connections from the funnel valve 49 and at the external waste container to ensure a liquid tight fit.

Open the valves.

Begin staining and monitor the waste container(s) so as not to overfill.

When full, move the labeled full container in the Central (Main) Accumulation Area and replace with an empty labeled container.

When complete or leaving the room, please make sure waste collection vessels are closed. Please make sure the drain valves are in the closed (cross stream) position. Please place the lid on the device.

Figure 12A:
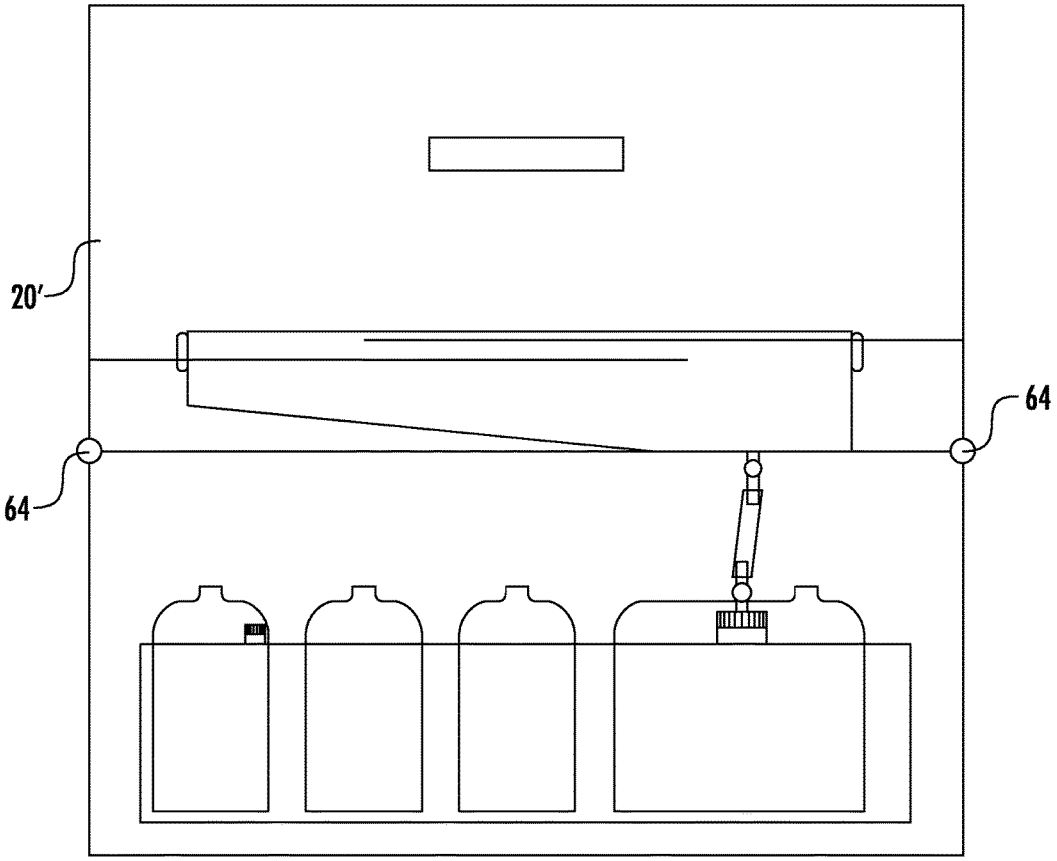
FIGS. 12A-B is a schematic of a fully self-contained and portable microbiology staining and waste containment kit in accordance with the invention.
Figure 12B:
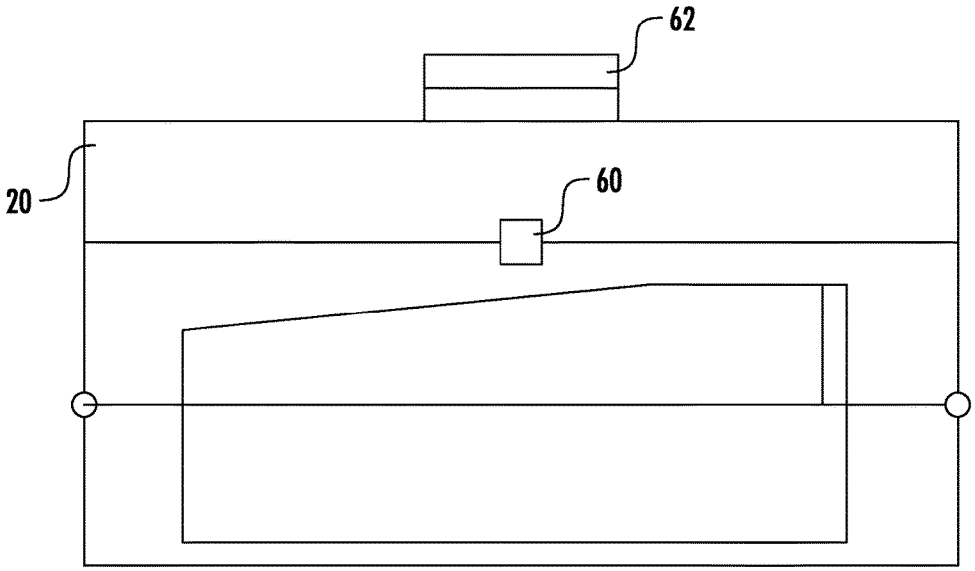

The invention is not limited to the above description. For example, the funnel, with either flange attachment, may be used over a different waste collection container or outer containment vessel as the Waste Generator so chooses. The generator should be mindful of containment with whichever option is used. Also, the wholly contained system having the inner secondary containment vessel is aptly designed for portable use, e.g., either to be carried from one location in a lab to another or from one lab to another, or for use in the field, e.g., during a rural disease outbreak, during wartime, etc. In such cases, as shown in FIGS. 12A-B, the lid will preferably lock to the outer containment vessel 10 via locking mechanism 60, and the device will include one or more handles 62, either disposed on the exterior of the lid, or on the exterior of the outer containment vessel, or the like. In the embodiment of FIG. 12, lid 20' may be hingedly attached to outer vessel 10 via hinges 64 so as not to get separated. Alternatively, the lid could be completely removable from vessel 10 and still lock thereto, e.g., via mason-jar-type clips, or the like. In either event, funnel 40 may be stored upside-down atop inner containment vessel 30 as shown in FIG. 12B. Funnel flanges 42 may telescope out of the way as mentioned above, or they may be hinged to fold out of the way, or be otherwise detachable and storable within vessel 10.

Additionally, the invention includes a non-transitory computer readable medium having instructions for making the above apparatus. The methods of making the apparatus can include additive manufacturing such as "3D printing" as well as any known or to be developed methods of manufacturing.

Having described certain embodiments of the invention, it should be understood that the invention is not limited to the above description or the attached exemplary drawings. Rather, the scope of the invention includes any equivalents thereof as would be appreciated by one of ordinary skill in the art.

What is claimed is:

1. A portable microbiology waste containment apparatus containing waste generated during microbiology slide staining procedures, comprising:

a primary containment vessel having side walls and an open top area;

a funnel in communication with said open top area;

a secondary containment vessel in fluid communication with said funnel;

a microbiology slide staining support disposed in one of i) said open top area, or ii) said funnel, adapted to support microbiology slides being prepared with microbiology staining chemicals that become microbiology waste following a microbiology slide staining procedure;

and a solid lid lockable onto said primary containment vessel across said open top area that, when locked onto said primary containment vessel, closes the entire said apparatus, and that, when placed upside down on a flat surface off of said primary containment vessel, can function as supplemental containment, wherein when the microbiology slides are stained on said microbiology slide staining support and microbiology waste is generated above said open top area, the microbiology waste is collected by said funnel and conducted to said secondary containment vessel, wherein said apparatus is completely self-contained and portable, said funnel further comprising flanges adapted to engage a lip in said primary containment vessel just below said open top area to position said funnel below said microbiology slide staining support, and wherein said flanges are telescopingly adjustable in length so as to accommodate primary containment vessels of different sizes.

2. A microbiology waste containment apparatus according to claim 1, said funnel being dimensioned substantially the same size as said open top area.

3. A microbiology waste containment apparatus according to claim 1, said secondary containment vessel comprising an inner containment vessel disposable within said primary containment vessel.

4. A microbiology waste containment apparatus according to claim 1, said secondary containment vessel comprising an external containment vessel outside of said primary containment vessel.

5. A microbiology waste containment apparatus according to claim 1, said funnel and said secondary containment vessel being connected by tubing.

6. A microbiology waste containment apparatus according to claim 1, said primary containment vessel further comprising storage space beneath said funnel for storing staining materials to be used in a slide staining procedure.

7. A microbiology waste containment apparatus according to claim 1, further comprising:

at least one handle disposed on an exterior of at least one of i) said lid, or ii) said primary containment vessel.

8. A microbiology waste containment apparatus according to claim 1, said microbiology slide staining support comprising a plurality of dowels disposed across at least one of i) said open top area, or ii) said funnel.

* * * * *